US009095738B2

(12) United States Patent
Senegal

(10) Patent No.: US 9,095,738 B2
(45) Date of Patent: Aug. 4, 2015

(54) EXERCISE APPARATUS

(76) Inventor: Reginald J. Senegal, Portland, OR (US)

( * ) Notice: Subject to any disclaimer, the term of this patent is extended or adjusted under 35 U.S.C. 154(b) by 802 days.

(21) Appl. No.: 12/961,408

(22) Filed: Dec. 6, 2010

(65) Prior Publication Data

US 2011/0143896 A1 Jun. 16, 2011

Related U.S. Application Data

(60) Provisional application No. 61/284,049, filed on Dec. 11, 2009, provisional application No. 61/293,186, filed on Jan. 7, 2010.

(51) Int. Cl.
*A63B 71/00* (2006.01)
*A63B 4/00* (2006.01)

(52) U.S. Cl.
CPC ..... *A63B 4/00* (2013.01)

(58) Field of Classification Search
USPC ..... 482/121–130, 139, 146, 147
See application file for complete search history.

(56) References Cited

U.S. PATENT DOCUMENTS

| | | | | |
|---|---|---|---|---|
| 3,024,021 | A | 3/1962 | Coplin et al. | |
| 3,612,520 | A | 10/1971 | Chang et al. | |
| D223,113 | S | 3/1972 | King | |
| 4,613,131 | A | 9/1986 | Anderson | |
| 4,801,140 | A | 1/1989 | Bergeron | |
| 5,766,119 | A | 6/1998 | Clark | |
| 5,813,066 | A | 9/1998 | Gebhard et al. | |
| 5,833,588 | A | 11/1998 | Connelly, III et al. | |
| D431,608 | S | 10/2000 | Lin | |
| 6,419,586 | B1 * | 7/2002 | Chiu | 472/25 |
| 6,461,285 | B1 | 10/2002 | Theunissen et al. | |
| D489,778 | S | 5/2004 | Fan et al. | |
| D495,014 | S | 8/2004 | Zabel | |
| D507,026 | S | 7/2005 | Chen | |
| 6,945,919 | B2 * | 9/2005 | Yang | 482/142 |
| 6,945,920 | B1 | 9/2005 | Kemery et al. | |
| D552,696 | S | 10/2007 | Hallar | |
| 7,357,766 | B2 * | 4/2008 | Langer et al. | 482/146 |
| 7,658,700 | B2 * | 2/2010 | Maloy et al. | 482/132 |
| D612,896 | S | 3/2010 | Talley | |
| 7,707,652 | B2 | 5/2010 | Senegal | |
| 7,722,506 | B2 | 5/2010 | Pratson et al. | |
| D627,015 | S | 11/2010 | Senegal | |
| 7,993,253 | B2 * | 8/2011 | Fernandez | 482/146 |

(Continued)

OTHER PUBLICATIONS

"Bosu® Total Training System with 4 DVD Workouts", http://www.bosu.com/scripts/cgiip.exe/WService=BOSU/itemdetl.html?item=BOSU_HOME3D, visited Apr. 2, 2010, 1 page.

(Continued)

*Primary Examiner* — Glenn Richman
(74) *Attorney, Agent, or Firm* — Mohr Intellectual Property Law Solutions, PC

(57) ABSTRACT

The present disclosure concerns an exercise device, and more particularly a combination balance and stability training and resistance training exercise device, comprising a platform and a balance element. The exercise device can also comprise one or more resilient, elongate resistance training elements for resistance training. The exercise device can be provided with a stabilizing device. When removed from the stabilizing device, the exercise device can be used in a manner similar to a conventional balance board. When mounted on the stabilizing device, the exercise device is supported in a stable orientation for performing exercises requiring a stable and balanced support surface.

20 Claims, 16 Drawing Sheets

(56) References Cited

U.S. PATENT DOCUMENTS

| | | | | |
|---|---|---|---|---|
| 8,678,985 | B2 * | 3/2014 | Mattox | 482/142 |
| 2010/0167887 | A1 * | 7/2010 | Berry | 482/147 |
| 2011/0143896 | A1 * | 6/2011 | Senegal | 482/139 |

OTHER PUBLICATIONS

"FitBall® Deluxe Board", http://www.balldynamics.com/product_info.php/cPath/58/products_id/377, visited Apr. 2, 2010, 1 page.

"My Gym—Official Site of AsSeenOnTV.com—The Total Body Conditioning System", http://www.asseenontv.com/prod-pages/my_gym.html, visited Apr. 2, 2010, 1 page.

"Reebok Core Board", http://www.performbetter.com/detail.aspx_Q_ID_E_3557_A_CategoryID_E_231, visited Apr. 2, 2010, 1 page.

SPRI Slanted Riser™ for use with the Original Step™, http://www.fitnessgiant.com/spslri.html, visited Apr. 2, 2010, 1 page.

* cited by examiner

FIG. 10
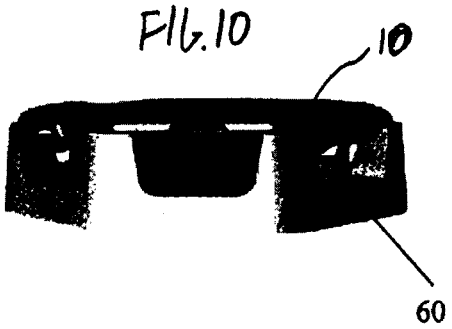
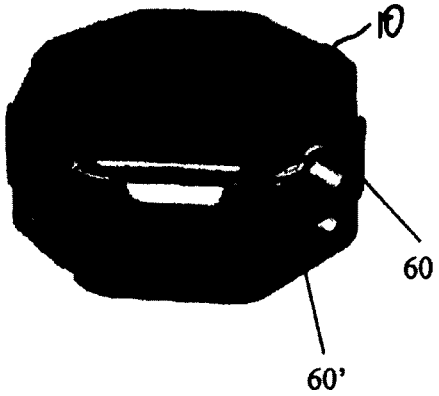
FIG. 11

EXERCISE APPARATUS

CROSS REFERENCE TO RELATED APPLICATIONS

The present application claims the benefit of U.S. Provisional Application No. 61/284,049, filed Dec. 11, 2009, and U.S. Provisional Application No. 61/293,186, filed Jan. 7, 2010, both of which applications are incorporated herein by reference.

FIELD

This disclosure concerns exercise systems, and more particularly but not exclusively, to exercise systems suitable for resistance training, balance training, stability training or combinations thereof.

BACKGROUND

A multitude of personal exercise devices are known for performing various types of exercises and training activities. For example, there are various types of "balance boards" on the market that are used for balance training. A typical balance board includes a flat upper surface or platform and a semi-spherical lower surface that allows a user standing on the platform to perform balance or stability training movements. Other types of personal exercise devices include resistance training elements, usually in the form of elastomeric bands that can be used to perform various resistance training exercises. Still other types of personal exercise devices have one or more stable surfaces that can be used for step aerobic exercises or for supporting the body in a standing or lying position for strength conditioning exercises. The problem with most personal exercise devices on the market is that they are quite limited in use.

What is needed is a new and improved exercise device that provides a user with a greater degree of flexibility in terms of the types of exercises and training activities that can be performed with the device.

SUMMARY

The present disclosure concerns an exercise device, and more particularly a combination balance and stability training and resistance training exercise device, comprising a platform and a balance element. The exercise device can also comprise one or more resilient, elongate resistance training elements for resistance training. The exercise device can be provided with a stabilizing device. When removed from the stabilizing device, the exercise device can be used in a manner similar to a conventional balance board. When mounted on the stabilizing device, the exercise device is supported in a stable orientation for performing exercises requiring a stable and balanced support surface.

In accordance with one representative embodiment, an exercise apparatus comprises a balancing device comprising a platform and a balancing element coupled to the platform. The platform has an upper surface configured to support the weight of a user and the balancing element has an unstable lower surface that causes the balancing device to be unstable when the balancing element is placed on a support surface. The apparatus can further include a stabilizing element configured to support the balancing device in a stable orientation. The balancing device is removably mountable on the stabilizing element such that when the balancing device is mounted on the stabilizing element, the balancing device is supported for use in a stable orientation, and the balancing device can be removed from the stabilizing element for use in an unstable state.

In another representative embodiment, an exercise device comprises a support platform, the platform having an upper surface configured to support the weight of a user and a peripheral edge portion comprising first and second handles on opposing sides of the platform. The exercise device further includes a balancing element coupled to the platform, the balancing element having an unstable lower surface that causes the balancing device to be unstable when the balancing element is placed on a support surface. Each handle of the platform desirably is rotatable about its longitudinal axis.

In another representative embodiment, an exercise device comprises a support platform having an upper surface configured to support the weight of a user and a balancing element coupled to the platform. The balancing element has an unstable lower surface that causes the balancing device to be unstable when the balancing element is placed on a support surface. The exercise device further includes at least one resilient, elongated resistive training element having a first portion anchored inside of the platform and a second portion that extends outwardly through an aperture in the platform for engagement by a user in resistance training.

The foregoing and other features and advantages of the invention will become more apparent from the following detailed description, which proceeds with reference to the accompanying figures.

BRIEF DESCRIPTION OF THE DRAWINGS

FIG. 10 is a side view of the exercise device and stabilizing device of FIG. 9.

FIG. 11 is a perspective view of the exercise device and stabilizing device of FIG. 9 mounted on top of an additional stabilizing device.

DETAILED DESCRIPTION

The following describes various principles related to exercise systems with reference to exemplary exercise apparatus and methods.

Overview

Figure 2:
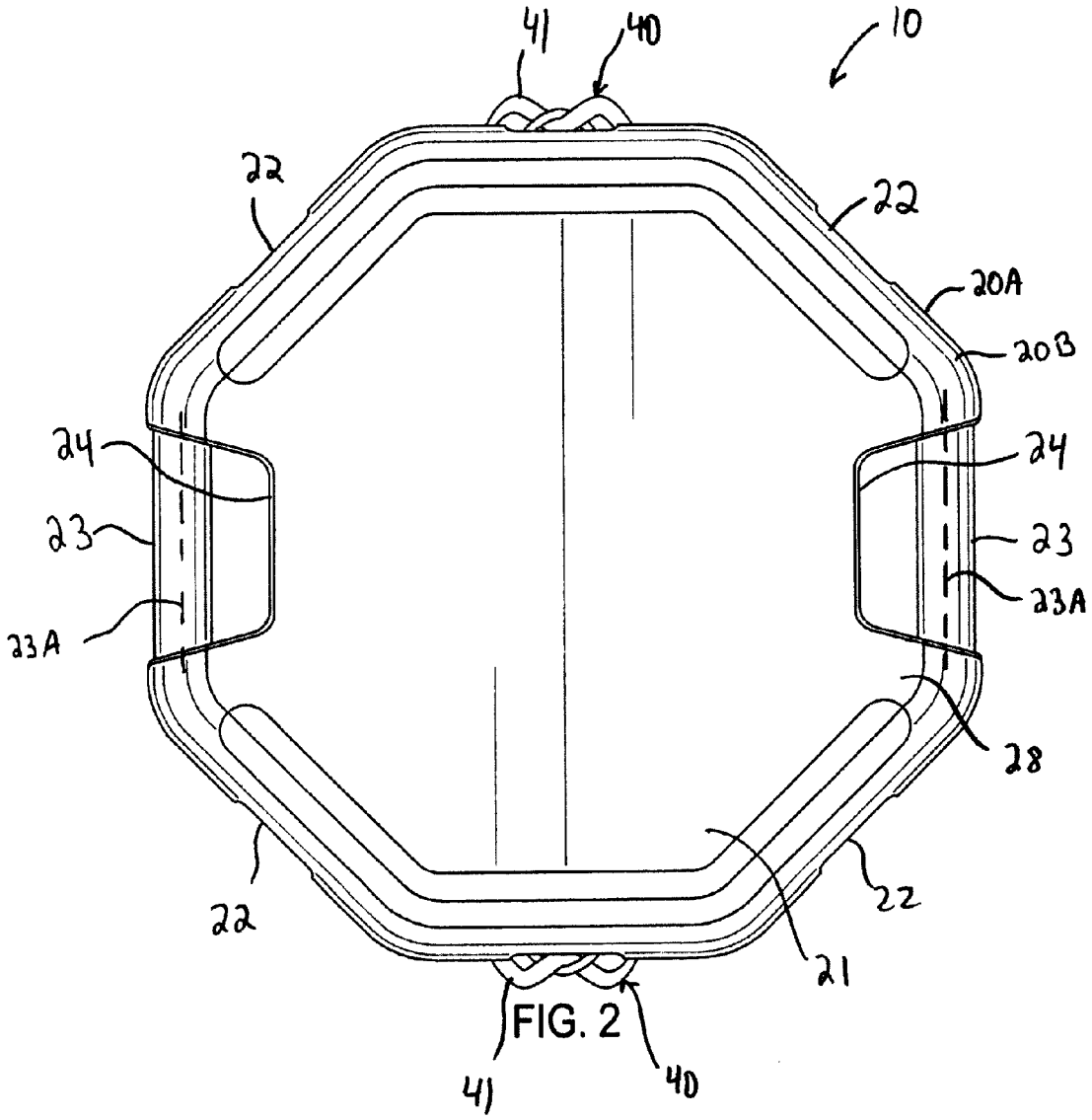
FIG. 2 is a top plan view of the exercise device of FIG. 1.
Figure 3:
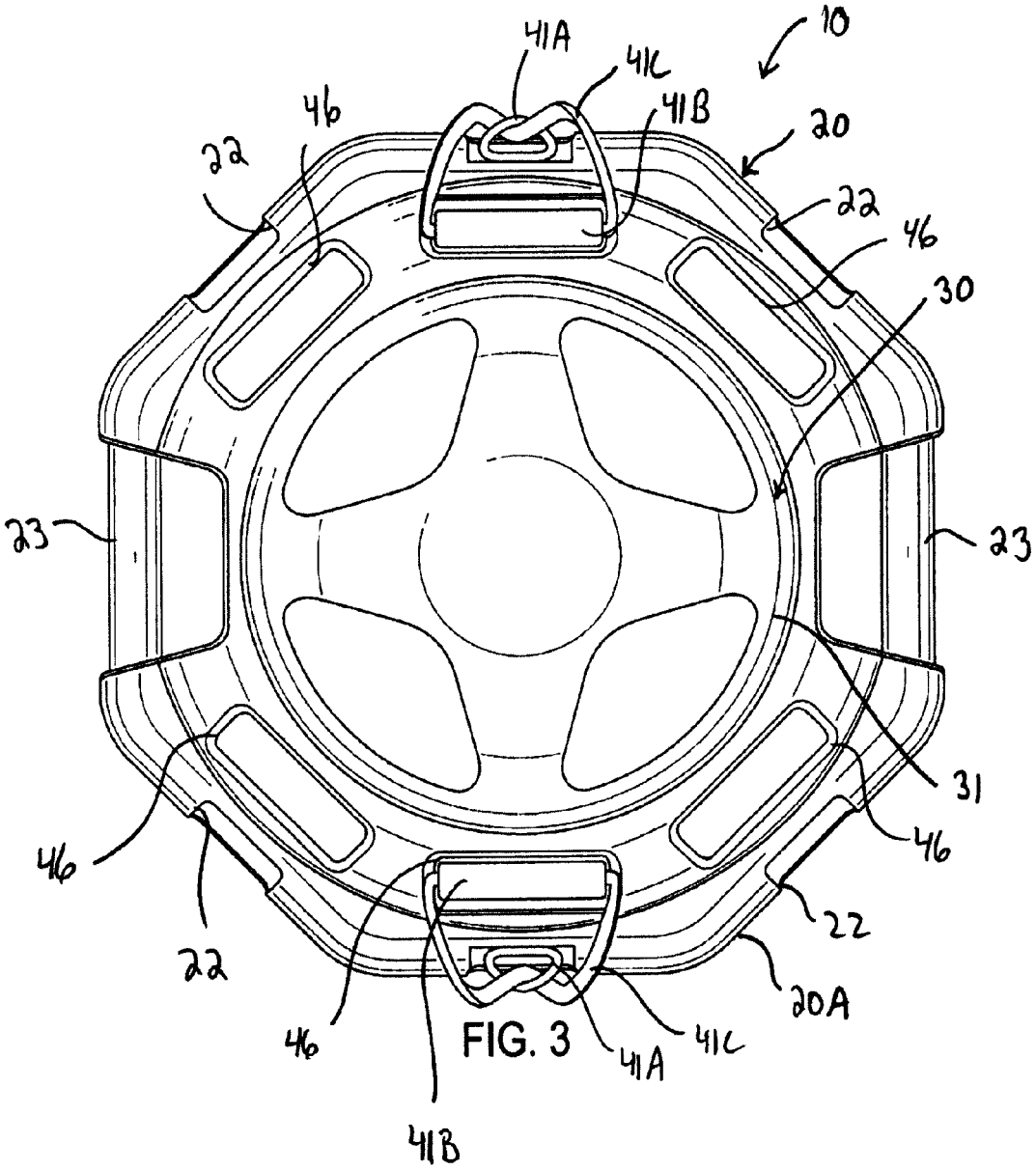
FIG. 3 is a bottom plan view of the exercise device of FIG. 1.
Figure 4:
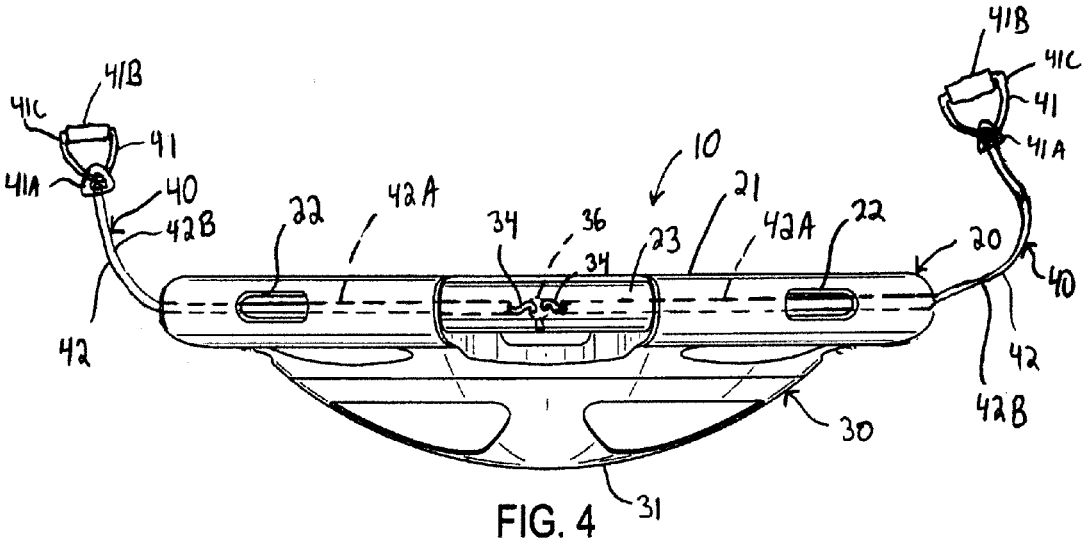
FIG. 4 is a side elevation view of the exercise device of FIG. 1.
Figure 5:
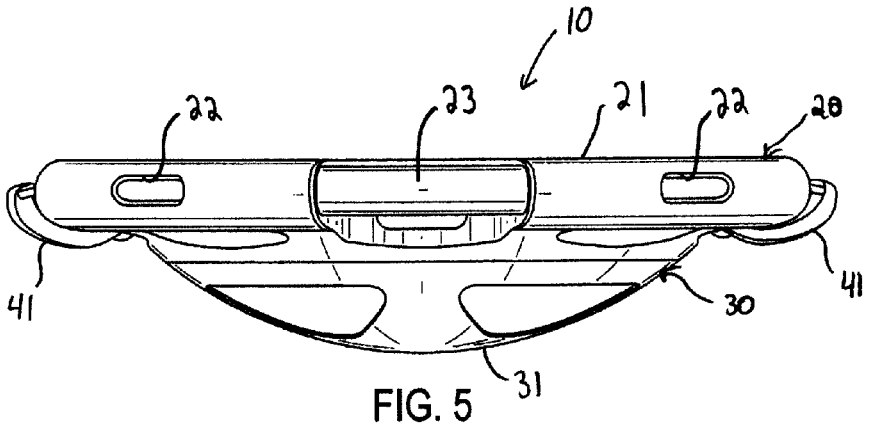
FIG. 5 is a side elevation view of the exercise device of FIG. 1 rotated 180 degrees from the position shown in FIG. 4.
Figure 6:
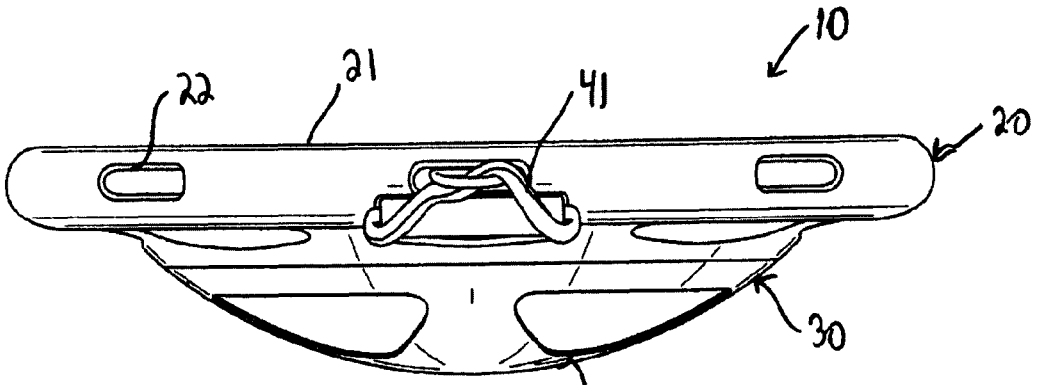
FIG. 6 is a side elevation view of the exercise device of FIG. 1 rotated 90 degrees from the position shown in FIG. 4.
Figure 7:
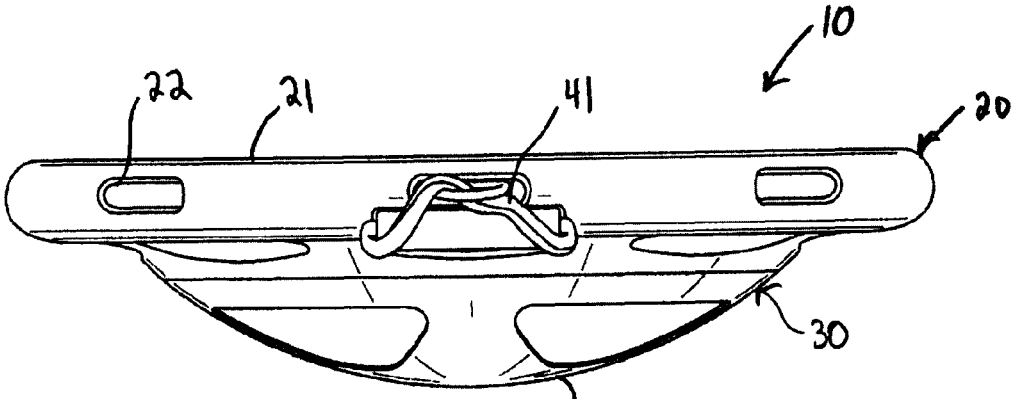
FIG. 7 is a side elevation view of the exercise device of FIG. 1 rotated 180 degrees from the position shown in FIG. 6.
Figure 8:
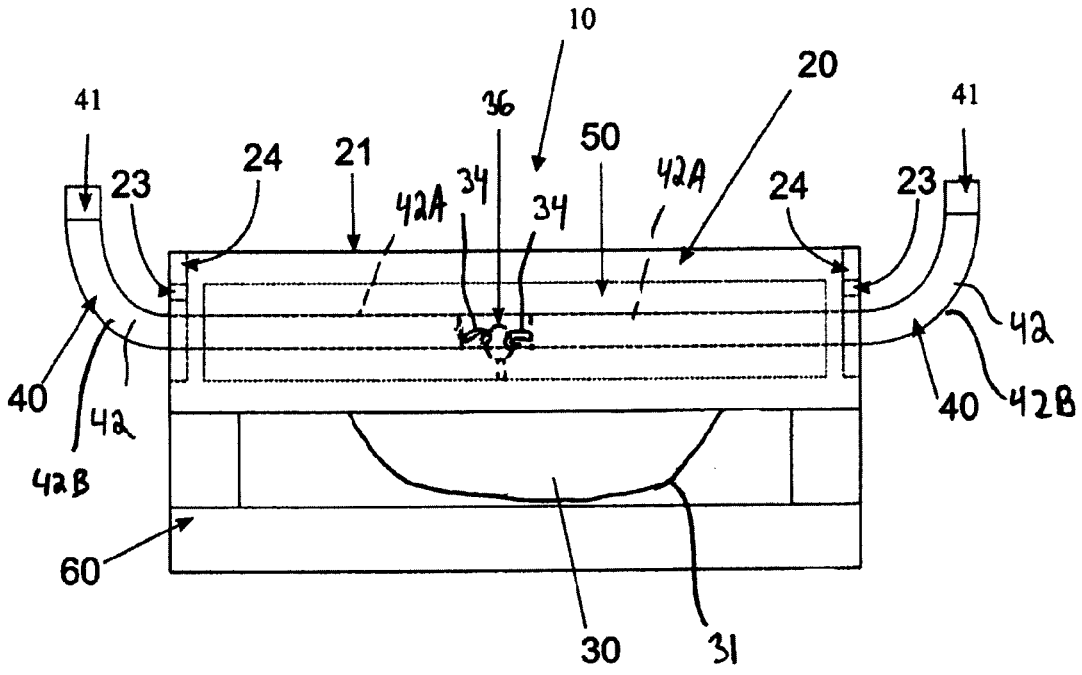
FIG. 8 is a schematic side elevation view of the exercise device of FIG. 1 mounted on a stabilizing device.
Figure 13:
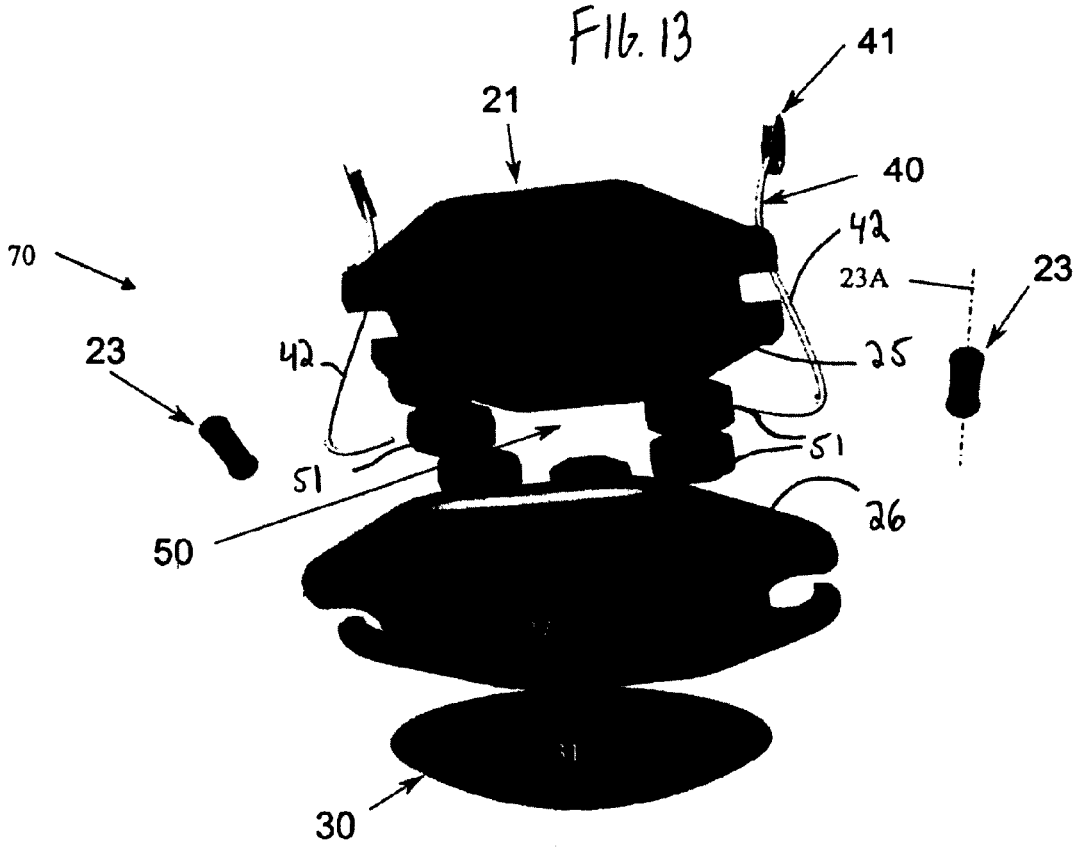
FIG. 13 is an exploded perspective view of an alternative embodiment of an exercise device.

Referring to FIGS. 1-7, one example 10 of an exercise device, and more particularly a combination balance and stability training and resistance training exercise device, comprising a platform 20 and a balance element 30 will be described. As described more fully below and as best shown in FIGS. 4, 8 and 13, such an exercise device can also comprise one or more resilient, elongate resistance training elements 40 passing through, or anchored or secured within, an interior region 50 (e.g., an open, unobstructed passageway) defined by the platform 20. FIG. 13 shows an alternative embodiment 70 of such a combination exercise device.

Figure 14:
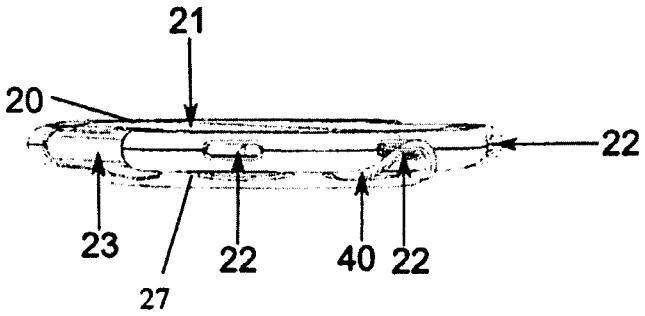
FIG. 14 shows a side elevation view of the exercise device shown in FIG. 1 in a low-profile stable configuration having a balance element removed.
Figure 15:
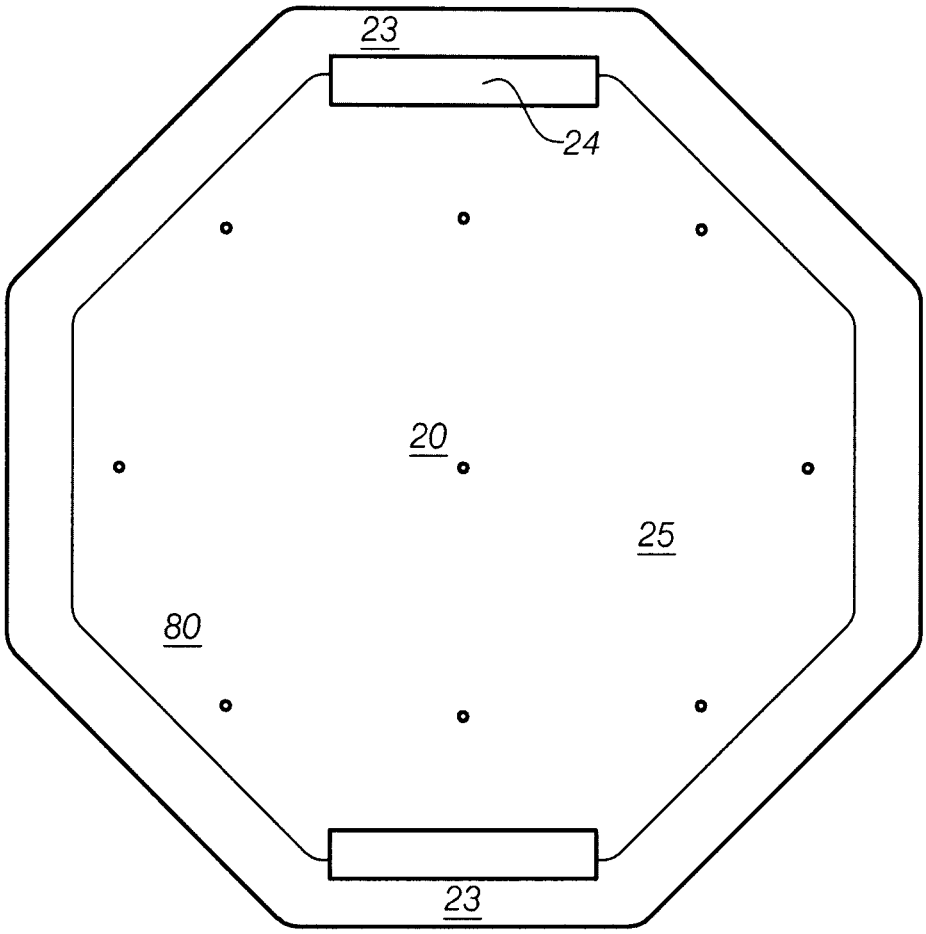
FIG. 15 is a photograph of a top plan view of a working embodiment of an exercise device comprising a platform, a balance element and a resistance element as disclosed herein.

As shown in, for example, FIGS. 9-11 and 14, such an exercise device 10 (also referred to as a balancing device) can also be configured for use in a stable orientation (i.e., the device 10 can be supported such that the platform 20 lies stably within a substantially horizontal plane during use). In FIG. 14, the exercise device 10 is shown in a low-profile stable configuration. In the configuration shown in FIG. 14, and by way of reference to the device 10 shown in FIG. 1, the balance element 30 has been removed from the platform 20 providing a substantially flat lower surface 27 upon which the platform can rest. To provide a low-profile stable configuration for the platform 20, the flat lower surface 27 can be placed on a stable horizontal surface, such as a floor.

Figure 9:
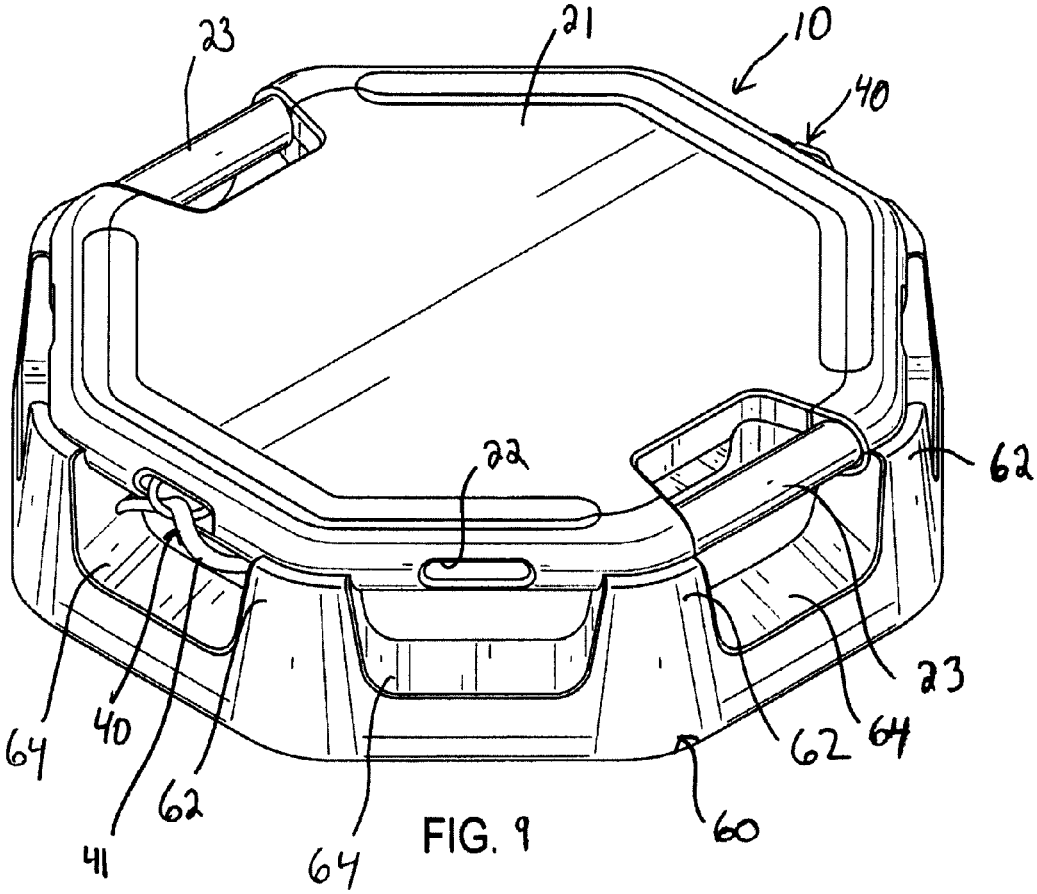
FIG. 9 is a perspective view of the exercise device of FIG. 1 mounting on a stabilizing device.

In FIGS. 9-11, the exercise device 10 is shown in an elevated stable configuration. For example, the platform 20 is shown being matingly engaged with and resting atop a stabilization element, or stand, 60 (also referred to as a stabilizing element). The stabilization element 60 can be configured to matingly receive one or more portions of the device 10 (e.g., a portion of the platform 20 and/or a portion of the balance element 30, if one is present). In FIG. 11, the exercise device 10 is shown in an alternative elevated stable configuration matingly engaged with and resting atop an upper stand 60. The upper stand 60 is shown matingly engaged with and resting atop a lower stand 60'.

Figure 1:
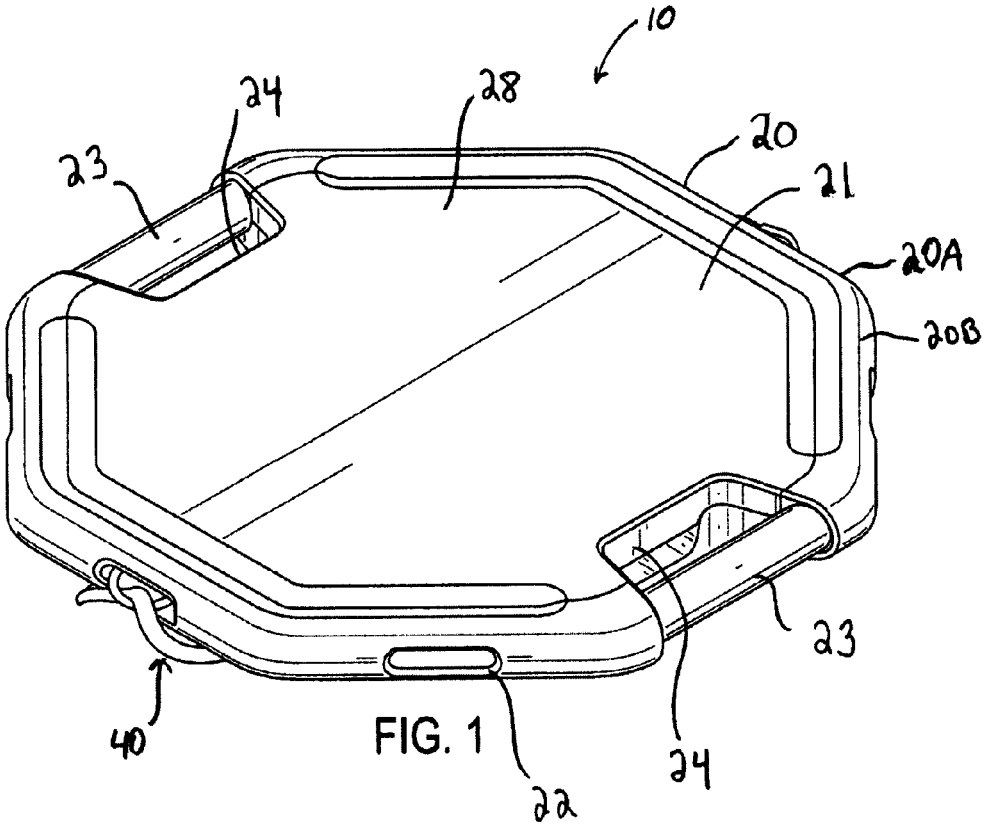
FIG. 1 is a top perspective view of one example of an exercise device, or a balance and stability device, comprising a platform and a balance element.

A combination exercise device 10 configured as shown in FIG. 1 can be incorporated in an exercise regimen comprising balance and stability training, resistance training, or both. Such exercise regimens will be described below by way of example and with reference to a working embodiment and FIGS. 15-19. In a stable configuration, the exercise device 10 can readily be used to perform "step-up" (e.g., group aerobic) exercises that have a reduced balance and stability training component, or to perform balance and/or stability training movements by those users who prefer to use a more stable device for such training.

Platform

As FIGS. 1-2 show, the platform 20 can have an upper surface 21 with a polygonal, e.g., an octagonal, periphery 20A. The periphery 20A can define other shapes (e.g., a circle, ellipse, square, rectangle, pentagon) without departing from the principles described herein.

In some embodiments, the platform 20 can have one or more gripping elements, or handles, 23 positioned in or adjacent a peripheral edge portion 20B of the platform 20. Some disclosed devices 10 have handles 23 positioned adjacent opposing outer regions of the platform 20, as shown in FIG. 1. Other embodiments provide more handles (e.g., one for each side of a polygon) or fewer handles (including none).

The peripheral edge portion 20B of the platform 20 comprising one or more handles 23 can be recessed so as to define a recessed region 24 adjacent each handle 23. The recessed region 24 can be sized to allow a user to grasp the handle with a clenched hand (e.g., opposed thumb and fingers circumferentially wrapping the handle) without interference between the user's hand and the platform 20 or upper surface 21. In such embodiments, a user can grasp one or two handles 23 with his hands while performing one or more exercise movements.

As described more fully below, the handles 23 can be grasped during a resistance training exercise movement, a balance and stability training movement, or both. In some instances, the handles 23 can be particularly well suited for stabilizing a user positioned on the surface 21 of the platform 20. Each handle 23 can be configured to rotate about a respective axis 23A (FIG. 2) extending longitudinally of the handle (e.g., opposing ends of each handle can be secured to the platform 20 with a pinned connection). Such a handle connection can allow the exercise device 10 to more freely tilt on the balance element 30 when a user is grasping the handles 23. Such a handle connection can also allow a user's hand, wrist and/or arm to maintain a substantially ergonomically correct alignment throughout an exercise movement.

As best shown in FIGS. 4 and 8, the exercise device 10 can also comprise one or more resistance training elements 40 (also referred to herein as "resistance members" or "resistive training elements"). In one embodiment, a resistance member 40 comprises an elongate member 42, each of which includes a first portion 42A anchored or fixed within the interior of the platform 20 and a second portion 42B extending outwardly from the platform and terminating at a respective body engagement member 41. The body engagement members 41 can be, for example, handles configured to be grasped by a user's hand, elongate belt members configured to fixedly attach one end of the elongate member to a user's wrist or ankle, or a hook or carabineer configured to removably and fixedly attach the corresponding end to an article of clothing, such as, for example a stationary or movable anchor on a user's vest, as disclosed in this inventor's U.S. Pat. No. 7,707,652, issued May 4, 2010, which is incorporated herein in its entirety by this reference. The elongate member 42 can comprise a resiliently elongatable piece of material (e.g., any of various synthetic or natural elastomers, such as rubber or latex). In other embodiments, the elongate member can comprise a spring and/or a coil. Such resistance training elements 40 can provide resistance to a user's movements during exercise (e.g., providing training benefit to the user working to stretch the resistance training elements).

The body engagement member 41 can be of any shape or design that allows a user to grasp the body engagement member with a hand and/or place the body engagement member around a foot during use of the resistance training element. As an illustrative, non-limiting example, a body engagement members 41 can comprise a metal ring 41A secured to the end of an elongate member 42, a hand grip, or gripping member, 42B, and a flexible strap 41C (e.g., a nylon webbing strap) extending through the ring and the gripping member. In other embodiments, the body engagement member 41 can be a flexible loop of material or a rigid metal or plastic ring secured to the end of the elongate member 42, such as shown in FIG. 13.

The exercise device 10 can comprise a plurality of resistance training elements 40 configured to provide different levels of resistance to modify the strenuousness of resistance strength training (e.g., each different resistance element can comprise a corresponding elastic material having a unique modulus of elasticity). Typically, one or two resistance training elements are used at one time to perform an exercise. Additional resistance training elements can be stored within the exercise device when not being used, as further described below.

With reference to the exercise device 10 shown in FIG. 8 and the exercise device 70 shown in FIG. 13, the platform 20 can have a platform interior region 50 that defines a passageway, channel or other unobstructed path extending between or among various regions adjacent or adjoining the periphery of the platform 20. A resistance training element 40 can extend at least partially through and can be anchored or fixed with the interior region 50 of the platform 20. In one implementation, as shown in FIGS. 4 and 8, the first portion 42A of a resistance training element 40 can be anchored or fixed within the platform (or at another convenient location in or on the exercise device 10), such as with a respective connector 34 (e.g., a metal hook) that can be hooked onto or otherwise secured to an anchor 36 (e.g., a metal ring) inside of the platform 20. In this manner, the resistance training element 40 can be easily removed and replaced with another resistance training element 40 of the desired resistance.

In another embodiment, a resistance training element 40 can extend completely through the platform such that the platform is positioned between two opposing end portions 42B of the resistance training element 40 that are located outside of the exercise device. Such a configuration can "capture" the portion of the elongate member 42 passing through the interior region 50 and can at least partially retain the elongate member 42 against a force applied to the body engagement members 41 and directed away from the platform 20. In some embodiments, such as the platform assembly shown in FIG. 13, the platform 20 can comprise opposed upper and lower members 25, 26 that matingly engage with each other and define the open passageway.

Some platforms 20 also include one or more guiding elements, or anchors, 51 positioned within the interior region 50. Such anchors 51 can be positioned within the interior region 50 so as to define one or more passages through the interior region, allowing the resistive training elements 40 to be routed through and extend from the platform 20 at one or more selectable angles. As shown in FIG. 13, the anchors 51 can be positioned between the upper and lower members 25, 26, forming the platform 20 and can anchor the resistance element 40 to the platform 20.

Such platforms 20 comprising a resistance training element 40 configured as just described can be particularly well suited for combined strength and balance training insofar as the balance element 30 does not interfere with the resistance training elements 40, and the resistance training elements 40 do not interfere with the balance element 30. Stated differently, a training element routed through the platform 20 allows the balance element 30 to freely engage a support surface (e.g., a floor) in a rolling contact without interference from the resistance member 40, allowing the platform to tilt through a wide range of angles, such as, for example, up to forty-five degrees, or more, from a horizontal position.

Some disclosed platforms define one or more openings 22 positioned adjacent or passing through a periphery 20A of the platform 20. Such openings can be sufficiently sized to allow a resistive training element 40 to pass therethrough. In some instances, the openings 22 are sufficiently sized as to allow a body engagement member 41 (e.g., a handle) of a resistance element 40 to pass therethrough. As shown, each opening 22 desirably is located diametrically opposite another opening 22. In this manner, two resistance training elements 40 can be positioned on opposite sides of the exercise device (as best shown in FIG. 4), which is useful for performing certain exercises requiring a training element on each side of the body, such as bent over rows (as depicted in FIG. 29).

The platform 20 can be sufficiently strong as to support a large adult (e.g., weighing in excess of 200 pounds) standing, lying or otherwise positioned on the upper surface 21 while performing exercise movements of the type described herein. In other embodiments, the platform 20 can sufficiently strong to support a child or small adult, but not a large adult, while performing exercise movements of the type described herein. Other embodiments have larger or smaller upper surface areas relative to a height of the balance element 30 or stand 60. Such alternative embodiments can be suitable for varying the difficulty of balance and stability training movements and/or for accommodating users of different builds.

The upper surface 21 of the platform can comprise a suitably rigid or deflectable material that provides adequate cushioning, or resiliency, for a user's comfort while performing exercise movements, while at the same time providing adequate strength for withstanding the movements. For instance, some embodiments can have a relatively stiff, hard upper surface comprising a rigid material such as, for example, wood, plastic or metal. Such embodiments can be well suited for use by those users who prefer a hard surface. Other embodiments can have an upper surface 21 comprising a more resilient, or cushioning material, such as, for example, a foam, a rubber, a gel and/or a visco-elastic material. Such embodiments can be suited for maintaining secure engagement between a user and the surface 21 (e.g., for maintaining a steady position while performing an exercise movement).

In particular embodiments, the upper surface 21 is part of a cover or lid 28 that is completely removable from the platform or is connected to the platform by hinge to permit access to interior space 50 within the platform in order to change the position of the resistance training element 40 or to select another resistance training element of a different resistance for use. As noted above, any resistance training elements that are not being used can be stored within the interior space of the platform.

Moreover, as best shown in FIG. 3, the lower surface of the platform can be formed with a plurality of openings or recesses 46. Each recess 46 can be sized to receive and retain a handle 41B of a resistance training element in a stored position when it is not being used.

Balance Elements

Some exercise devices 10, 70 (FIGS. 1-7 and 13, respectively) comprise a balance element 30. In some instances, the balance element is fixedly attached to a lower portion of the platform 20. In other instances, the balance element 30 and at least a portion of the platform 20 (e.g., the lower member 26) comprise a unitary construction.

In any event, such a balance element 30 comprises an unstable surface 31. As used herein, "unstable surface" means a surface configured to impart a degree of translational or rotational instability to an apparatus, such as, for example an exercise device as shown in FIG. 1. Some unstable surfaces 31 are convex. Placing a convex surface of a balance element 30 in contact with a substantially flat (e.g., planar) surface such as a typical floor in a weight room or a gymnasium makes the balance element's position and orientation unstable. Stated differently, placing the convex surface in contact with a flat surface makes it likely that the balance element will roll (and that any apparatus resting atop the balance element, such as, for example, a platform 20 as described above, will correspondingly tilt).

Exercise devices 10 that comprise a balance element 30 positioned beneath and supporting a platform 20 make it difficult for a user to maintain the platform 20 in a horizontal position. As used herein, "balance training" means practicing to maintain the platform 20 in a horizontal or substantially horizontal orientation despite the instability introduced by the unstable surface 31 from any of one or more exercise positions as disclosed herein.

An unstable surface 31 need not have a continuous convex curvature as shown in FIGS. 4 and 13. For example, a desired stability (relative to an unstable surface having a continuous convex curvature) can be introduced to exercise devices 10, for example, by providing a corresponding selected contour to the unstable surface 31. For example, an unstable surface 31 having a step-wise varying contour (e.g., a surface contour comprising a plurality of flat surfaces oriented at varying angles relative to each other, such as, for example, a dome formed by joining substantially planar triangles) can be provided. Such a step-wise varying contour (not shown) can introduce stability to the exercise device as compared to a continuous convex curvature, allowing for easier maintenance of the platform 20 in a horizontal orientation during exercise movements.

Other contours are also possible and can be selected based on the degree of instability desired for the exercise device 10, based on, among other considerations, the strength, agility and stamina of a user. For example, although the unstable surface 31 can be convex and semi-spherical in shape as shown in the drawings, some contours are semi-elliptical or stepwise varying. Some unstable surfaces 31 comprise flat regions and convexly curved regions.

In some embodiments, the balance training element 30 can be fixedly attached to the platform 20, and in other instances the balance element and the platform can comprise a unitary construction. In still other embodiments, the balance element 30 can be removably affixed to the platform 20 using a suitable mechanism for securing and removing the balance element from the platform 20. Exercise devices 10 having removable balance elements 30 can be particularly well suited for easy transportation or storage. Moreover, in some embodiments, the platform 20 can be configured to rotate relative to the balance element 30.

Balance elements 30 can comprise a stiff or substantially rigid construction, allowing the unstable surface 31 to maintain a high degree of instability when supporting the weight of a user positioned atop the platform 20. For example, some balance elements comprise a hard plastic, metal or wood construction. In other embodiments, the balance element 30 can be somewhat compliant so as to introduce a comparatively larger contact area between the balance element and a support surface (e.g., a floor) when supporting a user positioned atop the platform 20. Such compliant balance elements can comprise an inflatable bladder, or a substantially solid mass of foam, rubber or other compliant material. Some balance elements comprise a surface coating to promote adhesion to a support surface (e.g., to reduce the likelihood of slippage between the unstable surface 31 and the support surface, while still allowing the balance element to roll along the support surface). Some balance elements define one or more openings 35 through the unstable surface 31.

Elevated Stable Configuration

Some disclosed exercise devices can comprise one or more stabilizing elements 60 configured to elevate and/or stabilize the corresponding platform 20. Such stabilizing elements can maintain the platform 20 in a stable, substantially fixed horizontal orientation. Some stabilizing elements 60, 60' (FIGS. 9-11) elevate the balance training element 30 relative to an underlying support surface (e.g., a floor). Such embodiments can be particularly well suited to step aerobics training, stretching exercises, or in isolating resistance training movements for devices 10, 70 comprising a resistance training element 40.

As best shown in FIG. 9, the stabilizing element 60 can comprise one or more support portions 62 configured to mate with the lower surface of the platform so as to support the platform in a stable orientation. The stabilizing element 60 includes an interior space that is sized to receive the balance element 30 when the platform 20 is placed on the support portions 62. The platform 60 also desirably is formed with a plurality of recessed portions 64 between support portions 62 that are sized to provide clearance around handles 23 of the platform or the body engagement members 41 of the resistance training elements 40 so that these components of the device can be used when placed on the platform.

Figure 12:
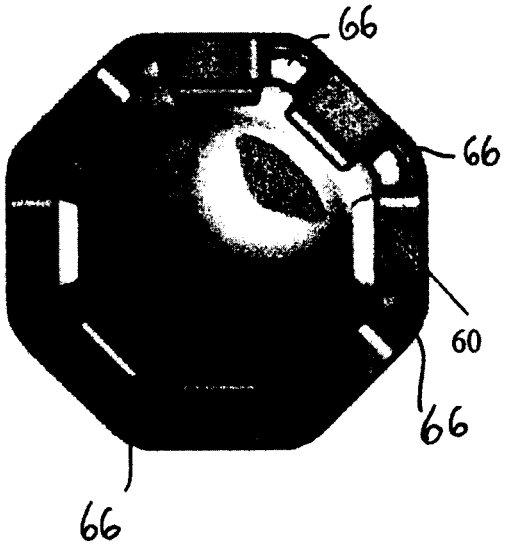
FIG. 12 is a bottom plan view of the exercise device and stabilizing device of FIG. 9.

Stabilizing elements 60 can be configured so as to be stackable on one another. As shown in FIG. 11, for example, an upper stabilizing element 60 supporting an exercise device 10 can be stacked on top of a lower stabilizing element 60'. Such stackable stabilizing elements can be particularly well suited for varying the elevation of a platform 20 to accommodate different levels of user fitness and/or practice. Accordingly, any number of stabilizing elements can be stacked one on top of each other to achieve the desired height for the upper surface 21 of the platform 20. Referring to FIG. 12, to facilitate stacking of the stabilizing elements, the support portions 62 of the stabilizing element 60 can be have open bottoms that open into receiving spaces 66. Thus, when one stabilizing element is stacked on top of another stabilizing element, the support portions 62 of the underlying stabilizing element extend partially into the receiving spaces 66 of the overlying stabilizing element, as depicted in FIG. 11.

Low-Profile Stable Configuration

Some platforms, as shown in FIGS. 13 and 14, define a substantially planar (e.g., flat) lower surface 27. Some lower surfaces are configured to removably receive and/or engage a balance element 30. When such a balance element 30 is installed, the platform 20 has an increased measure of instability as noted above and can tilt as the balance element 30 rolls on a support surface, such as a floor (not shown). When the balance element is removed (e.g., as shown in FIG. 14), the platform 20 has a decreased measure of instability. For example, the lower surface 27 can rest on the support surface (not shown) in a low-profile stable configuration, allowing the exercise device 10 to be used in connection with exercise movements requiring a stable platform or by users with insufficient strength, balance and/or practice to reliably and safely perform balance and stability training exercise movements on an unstable or unsupported device 10.

Other Embodiments

Figure 16:
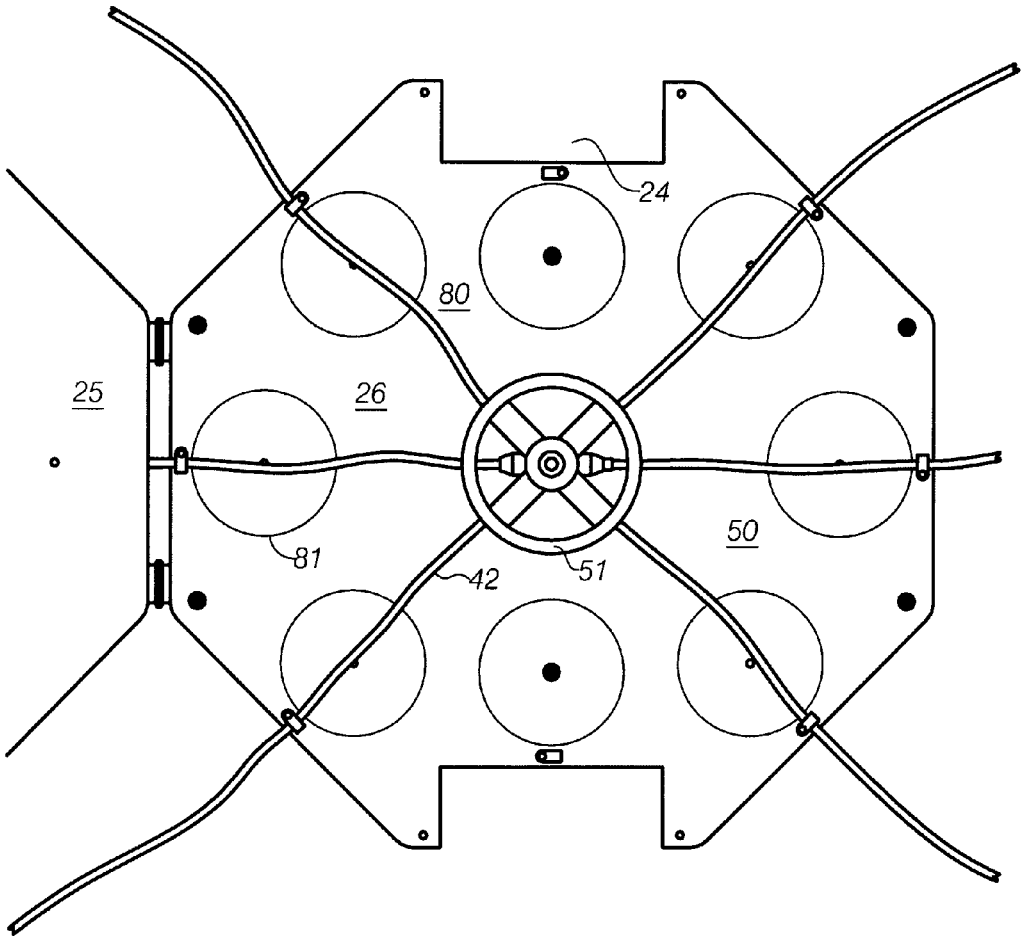
FIG. 16 is a photograph of a top plan view of an interior of the platform shown in FIG. 15.
Figure 17:
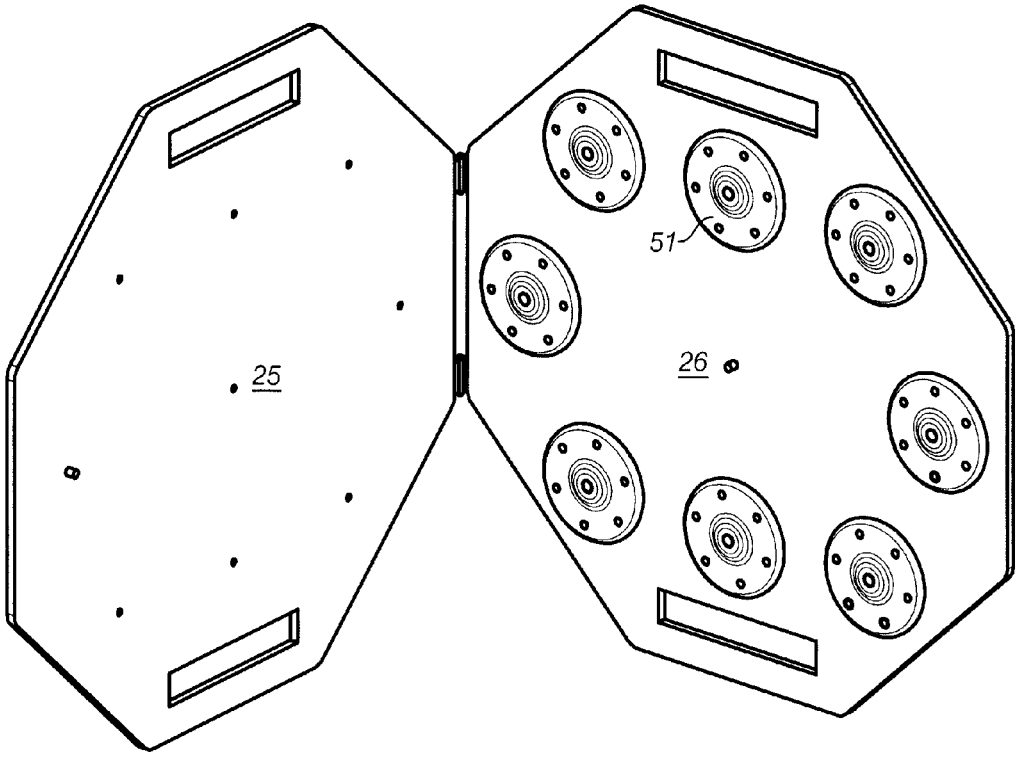
FIG. 17 is a photograph showing the interior of the platform shown in FIG. 15.

Photographs of various portions of two different working embodiments 80, 90 are shown in FIGS. 15-19. The platform 20 of each working embodiment comprises opposing upper and lower members 25, 26 with anchors 51 positioned therebetween at anchor locations 81 (FIGS. 16 and 17). The embodiment shown in FIG. 15 comprises wooden handles 23 and the recessed region 24 has been formed by removing a portion of the upper member 26 while leaving the handle portion 23. The lower member 26 has a recessed periphery with no handle portion, as shown in FIG. 16.

Figure 18:
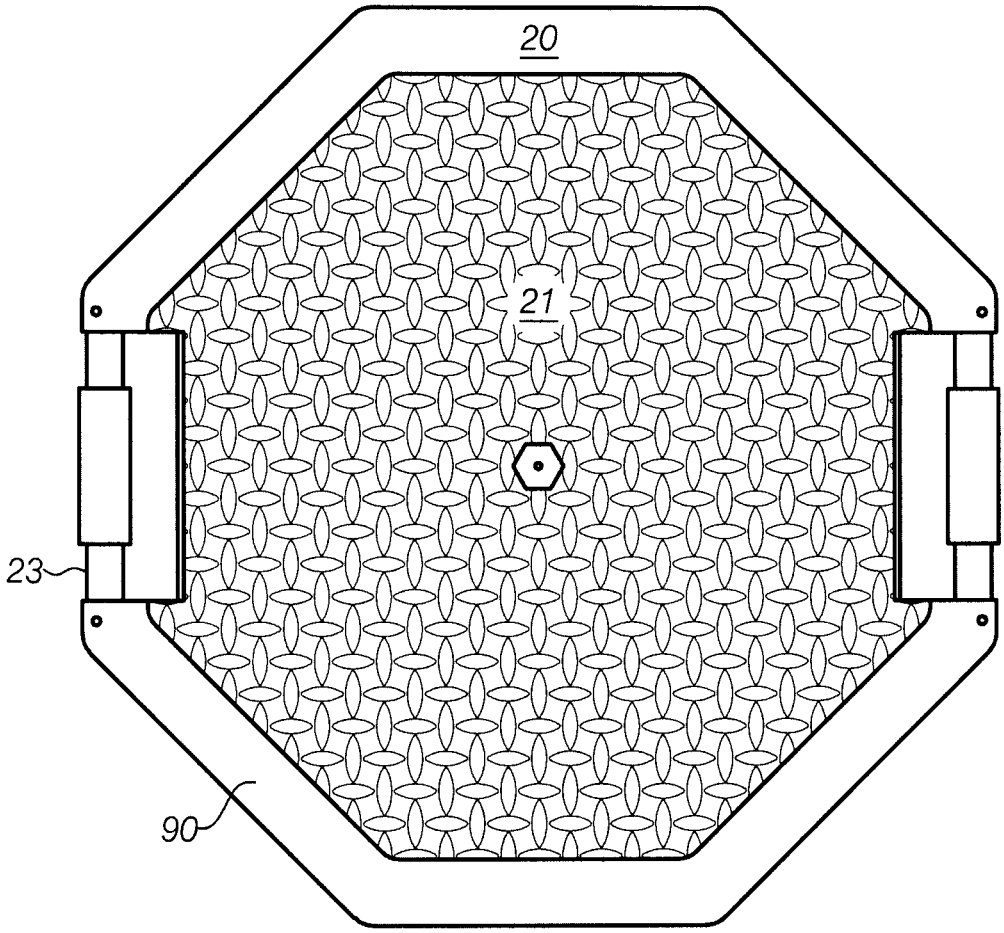
FIG. 18 is a photograph of a top plan view of another working embodiment of an exercise device comprising a platform, balance element and resistance training element as disclosed herein. The embodiment shown in FIG. 18 comprises a compliant pad on an upper surface of the platform.
Figure 19:
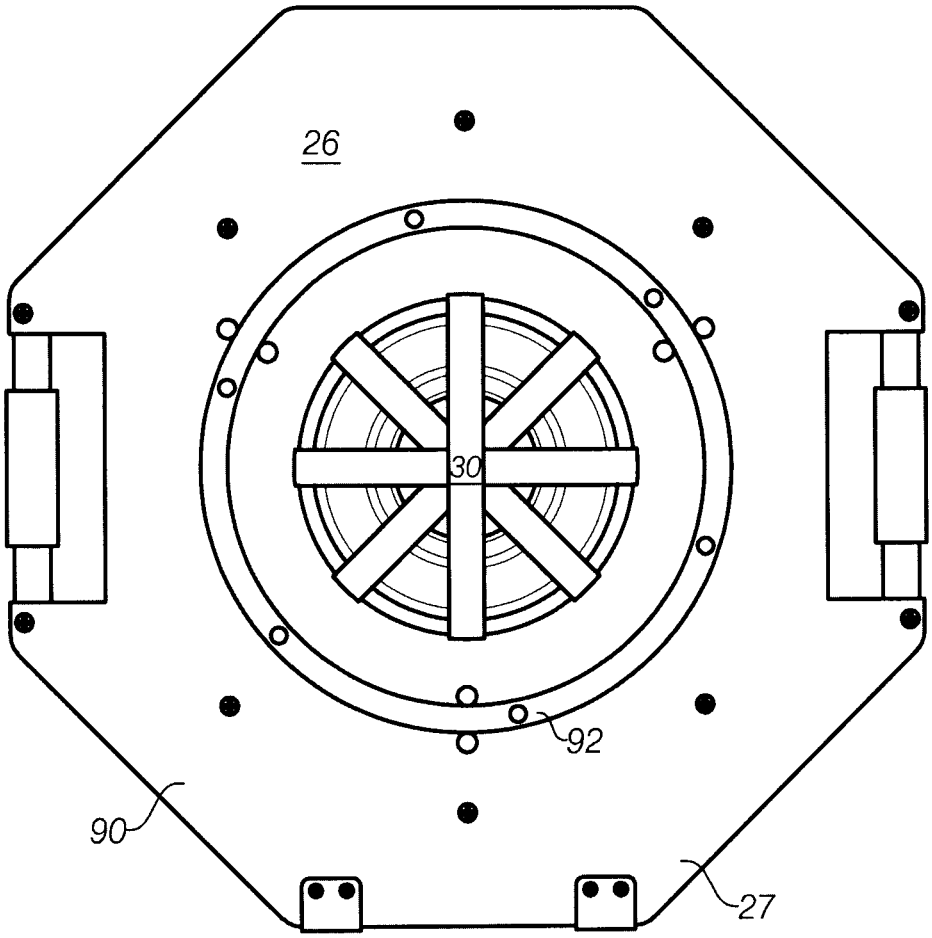
FIG. 19 is a photograph of a bottom plan view of a working embodiment of an exercise device as disclosed herein showing a working embodiment of a removable balance member and substantially planar lower surface.

A second working embodiment 90 is shown in FIG. 18. The upper surface 21 comprises a foam pad to add cushioning and resilience to the upper surface. The handles 23 are generally cylindrical in shape. As shown in FIG. 19, the balance element 30 has a diameter that about the same as the length of one side of the octagonal periphery. The lower surface 27 of the platform can include a support mechanism 92 that allows the platform to rotate relative to the support mechanism and an underlying support surface (e.g., a floor) when the balance element 30 is removed and the support mechanism 92 is placed directly on the underlying support surface. The support mechanism 92 can have a configuration that is similar to the ring from a "lazy susan" device.

Exemplary Training Methods

Combination exercise devices as disclosed herein can be used in connection with various exercise movements that combine aspects of resistance (e.g., strength) training, balance training and stability training. Such combination exercise movements can be particularly desirable for users who desire a well-rounded, full-body workout with a minimum of equipment.

A working embodiment of an exercise device comprises a platform, a balance element, and a resistance element supported by (e.g., resting in) a stand. The working embodiment may be used in connection with squat exercises, including neutral squats, front squats, diagonal squats, and quadruped glute extensions, with resistance. The working embodiment may be used for lunge exercises, such as reverse lunges, with resistance. The working embodiment may be used for other leg exercises, including leg raises and rear leg raises, with resistance.

The working embodiment of the exercise device may be used independent of the stand for squat or chest exercises, such as a chest press or core stabilization pushups, with resistance in combination with balance and stability training. The working embodiment of the exercise device may be used independent of the stand for a leg and/or back exercise with resistance in combination with balance and stability training, such as core stabilization glute extensions and core stabilization leg curls. The working embodiment may be used independent of the stand and in combination with an exercise ball.

The working embodiment may be used for back and shoulder exercises, such as bent-over rows, overhead shoulder presses, lateral shoulder raises, and rear deltoid raises. Additionally or alternatively, the working embodiment may be used with arm exercises, such as one-arm bicep curls and one-arm tricep extensions, with resistance. The working embodiment may further be used for torso exercises, such as core two-arm lawnmower pulls, with resistance. The working embodiment may also be used for jump training exercises, such as plyometric drills, with resistance.

The working embodiment may be used for core training exercises, such as pelvic lifts, pelvic lifts with alternating leg lifts, ab challengers, dual leg lift ab challengers, alternating one-leg ab challengers, in-and-out ab challengers, and incline abdominal crunches, with resistance.

This disclosure makes reference to the accompanying drawings which form a part hereof, wherein like numerals designate like parts throughout. The drawings illustrate specific embodiments, but other embodiments can be formed and structural changes can be made without departing from the intended scope of this disclosure. Directions and references (e.g., up, down, top, bottom, left, right, rearward, forward, etc.) can be used to facilitate discussion of the drawings but are not intended to be limiting. For example, certain terms can be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" as well as "and" and "or."

Accordingly, this detailed description shall not be construed in a limiting sense, and following a review of this disclosure, those of ordinary skill in the art will appreciate the wide variety of exercise apparatus that can be devised and constructed using the various concepts described herein.

I claim:

1. An exercise apparatus comprising:

a balancing device comprising:

a platform having:

a support structure defining the periphery of the platform;

an upper surface disposed on the support structure and configured to support the weight of a user, an interior region defining open space within the support structure; and an anchor disposed within the interior region and to configured to couple with a resilient resistive training element routed through the open space within the support structure; and a balancing element coupled to the platform, the balancing element having an unstable lower surface that causes the balancing device to be unstable when the balancing element is placed on a support surface; and a stabilizing element configured to support the balancing device in a stable orientation, the balancing device being removably mountable on the stabilizing element such that when the balancing device is mounted on the stabilizing element, the balancing device is supported for use in a stable orientation, and the balancing device can be removed from the stabilizing element for use in an unstable state.

2. The exercise apparatus of claim 1, wherein the platform comprises first and second handles on opposing sides of the platform.

3. The exercise apparatus of claim 2, wherein each handle has a longitudinal axis and is rotatable about its longitudinal axis.

4. The exercise apparatus of claim 1, wherein the platform is rotatable relative to the balancing element.

5. The exercise apparatus of claim 1, wherein the balancing element is semi-spherical in shape.

6. The exercise apparatus of claim 1, further comprising one or more resilient resistive training elements coupled to the balancing device.

7. The exercise apparatus of claim 6, wherein the one or more resistive training elements comprises a handle at one end thereof.

8. The exercise apparatus of claim 6, wherein the one or more resistive training elements comprises one or more elastomeric cords.

9. The exercise apparatus of claim 8, wherein the balancing device includes at least one aperture, and the cord includes a first portion that is fixedly anchored to the anchor disposed within the interior region of the balancing device and a second portion that extends outwardly through the aperture in the balancing device for use in resistance training.

10. The exercise apparatus of claim 9, wherein the at least one aperture comprises a plurality of apertures spaced around a side surface of the platform, and the second portion of the cord can be selectively positioned by a user to extend through one of the apertures.

11. The exercise apparatus of claim 1, wherein the stabilizing element comprises an interior space, an upper opening in communication with the interior space, and one or more support portions configured to support the platform on top of the support portions with the balancing element disposed in the interior space.

12. The exercise device of claim 1, wherein the platform includes a guiding element disposed within the interior region and defining at least two passages through the interior region, the at least two passages defining different angles through which the resilient resistive training element may be routed through the interior region and the different angles causing the resilient resistive training element to thereby resist lengthening to different degrees depending on which of the at least two passages the resilient resistive training element passes through.

13. The exercise device of claim 1, wherein the platform includes a first guiding element and a second guiding element disposed within the interior region and collectively defining at least two passages through the interior region, the at least two passages defining different angles through which the, resilient resistive training element may be routed through the interior region and the different angles causing the resilient resistive training element to thereby resist lengthening to different degrees depending on which of the at least two passages the resilient resistive training element passes through.

14. The exercise device of claim 1, wherein the upper surface is selectively removable from the support structure to make accessible the interior region of the platform.

15. An exercise device comprising:

a support platform, the platform haying an upper surface configured to support the weight of a user and a peripheral edge portion comprising first and second handles on opposing sides of the platform;

a balancing element coupled to the platform, the balancing element having an unstable lower surface that causes the balancing device to be unstable when the balancing element is placed on a support surface; and a stabilizing element onto which the support platform may be removably and matingly mounted, the stabilizing element configured to be disposed between the support surface and the support platform and including at least two support portions disposed proximate the peripheral edge portion of the support platform when the support platform is mounted on the stabilizing element, the at least two support portions configured to support the peripheral edge portion of the support platform and defining an interior space between the at least two support portions to receive the balancing element within the interior space when the support platform is mounted on the stabilizing element;

wherein the support platform mounted on the stabilizing element with the balancing element disposed within the interior space defines a stable configuration and the support platform supported from the support surface by the balancing element with the stabilizing element removed defines an unstable configuration.

16. The exercise device of claim 15, wherein each of the handles has a longitudinal axis and is rotatable about its longitudinal axis.

17. The exercise device of claim 15, wherein the longitudinal axes are parallel to each other and the upper surface of the platform.

18. The exercise device of 15, comprising a plurality of resilient, elongated resistive training elements, each having a first portion anchored inside of the platform and second portion that extends outwardly through an aperture in the peripheral edge portion of the platform for engagement by a user in resistance training.

19. The exercise device of claim 15, wherein the unstable lower surface of the balancing element is spaced from the stabilizing element and the support surface when the support platform is mounted on the stabilizing element.

20. The exercise device of claim 15, wherein the stabilizing element defines a first stabilizing element and further comprising a second stabilizing dement configured to support the first stabilizing element from the support surface when the support platform is mounted on the first stabilizing element.

* * * * *